US009312081B2

(12) United States Patent
Douglass

(10) Patent No.: US 9,312,081 B2
(45) Date of Patent: Apr. 12, 2016

(54) ARCLESS FUSIBLE SWITCH DISCONNECT DEVICE FOR DC CIRCUITS

(75) Inventor: Robert Stephen Douglass, Wildwood, MO (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 821 days.

(21) Appl. No.: 13/569,282

(22) Filed: Aug. 8, 2012

(65) Prior Publication Data

US 2014/0043133 A1 Feb. 13, 2014

(51) Int. Cl.

| | |
|---|---|
| ***H01H 89/00*** | (2006.01) |
| ***H01H 9/10*** | (2006.01) |
| ***H01H 9/54*** | (2006.01) |

(52) U.S. Cl.

CPC ..... *H01H 9/10* (2013.01); *H01H 9/106* (2013.01); *H01H 9/547* (2013.01); *H01H 89/00* (2013.01); *H01H 2089/005* (2013.01)

(58) Field of Classification Search

CPC ..... H01H 9/10; H01H 9/106; H01H 9/547; H01H 89/00; H01H 2089/005

USPC ..... 337/4; 361/8, 12, 13

See application file for complete search history.

(56) References Cited

U.S. PATENT DOCUMENTS

| | | | | |
|---|---|---|---|---|
| 3,466,503 | A * | 9/1969 | Goldberg | 361/12 |
| 4,206,443 | A * | 6/1980 | Britton | H02H 3/033 307/139 |
| 4,636,907 | A | 1/1987 | Howell | |
| 4,700,256 | A | 10/1987 | Howell | |
| 4,788,415 | A * | 11/1988 | Whipple, Jr. | F24C 15/106 219/483 |
| 5,339,210 | A * | 8/1994 | Howell | H01H 9/542 361/10 |
| 5,925,920 | A * | 7/1999 | MacArthur et al. | 257/530 |
| 6,903,911 | B2 * | 6/2005 | Reischer et al. | 361/91.7 |
| 6,914,416 | B2 * | 7/2005 | Thomas et al. | 320/136 |
| 7,474,194 | B2 | 1/2009 | Darr et al. | |
| 7,495,540 | B2 | 2/2009 | Darr et al. | |
| 7,924,136 | B2 | 4/2011 | Darr et al. | |
| 2004/0066587 | A1 * | 4/2004 | Schasfoort | H01H 9/542 361/8 |
| 2009/0128280 | A1 * | 5/2009 | Darr et al. | 337/4 |
| 2011/0292551 | A1 * | 12/2011 | Zheng | H01H 9/541 361/8 |
| 2012/0134062 | A1 * | 5/2012 | Wortberg | 361/87 |

* cited by examiner

*Primary Examiner* — Anatoly Vortman
*Assistant Examiner* — Jacob Crum
(74) *Attorney, Agent, or Firm* — Armstrong Teasdale LLP

(57) ABSTRACT

A fusible switch disconnect includes a fuse, a primary switch connected in series with the fuse. and a semiconductor switch device connected in parallel with the fuse. The semiconductor device is configured to resist current flow through the fuse and the primary fuse to facilitate arcless operation of the primary switch when connected to energized, DC circuitry.

36 Claims, 5 Drawing Sheets

ARCLESS FUSIBLE SWITCH DISCONNECT DEVICE FOR DC CIRCUITS

BACKGROUND OF THE INVENTION

The field of the invention relates generally to circuit protection devices, and more specifically to fusible switch disconnect devices for protecting direct current (DC) circuitry.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and opens one or more circuits through the fuse to prevent electrical component damage.

A variety of fusible disconnect devices are known in the art wherein fused output power may be selectively switched from a power supply. Existing fusible disconnect switch devices, however, have not completely met the needs of those in the art.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Figure 1:
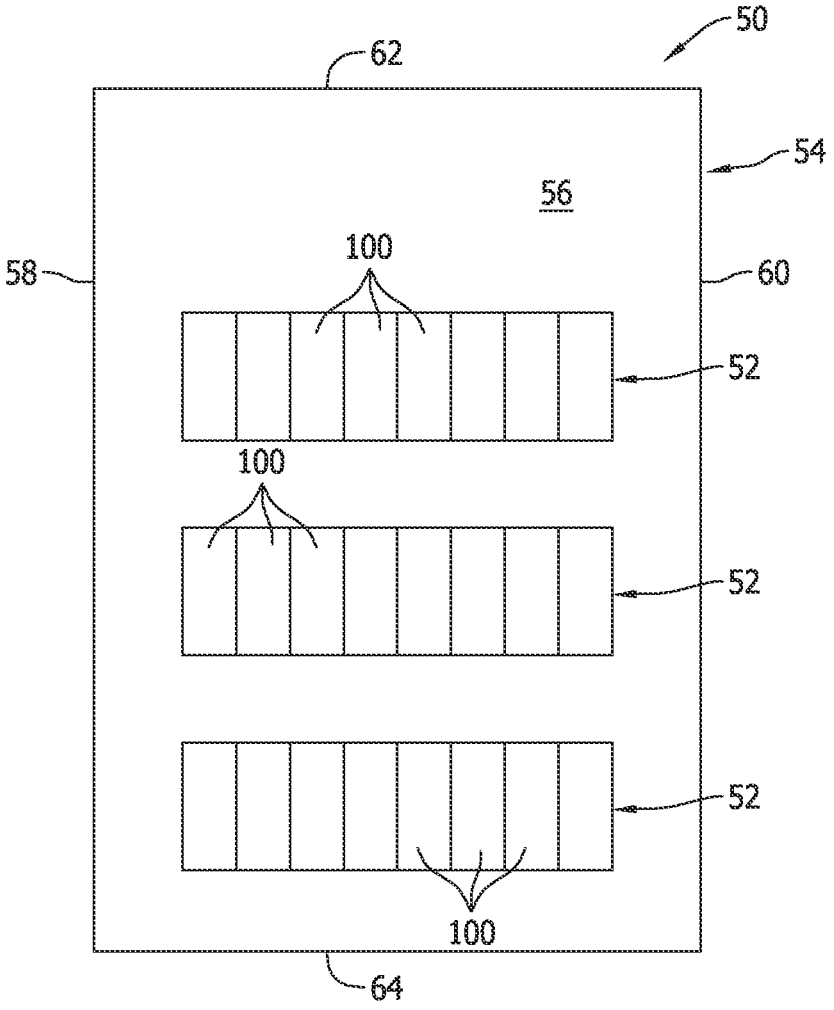
FIG. 1 is a front view of an array of fusible circuit protection devices.

Fusible circuit protection devices are sometimes utilized in an array on electrical panels and the like in an electrical power distribution system. Each fusible circuit protection device include a single fuse or multiple fuses depending on the application, and each fusible circuit protection device protects load side circuitry from overcurrent conditions and the like that may potentially damage load side systems and components.

One type of fusible circuit protection device is a fusible switch disconnect device. In such fusible switch disconnect devices, one or more switch contacts is provided to make or break electrical connection to and through a fuse. Fusible switch disconnect devices can be advantageous from a number of perspectives, but are nonetheless disadvantaged in certain applications.

For example, while conventional fusible switch disconnect devices are satisfactory for breaking alternating current (AC) circuitry by operation of a switch contact, the switching of high energy DC circuitry can be problematic. When switched under load, electrical arcing is typically generated at the switch contacts. Unlike AC current, where such arcing has an opportunity to extinguish at any voltage zero crossing of the alternating voltage wave, the DC current and voltage potential remain at a constant level during the breaking of switch contacts making it very difficult for the arc to extinguish. This constant DC voltage potential further tends to create sustained arcing conditions that will erode the switch contacts very quickly. Sustained high temperatures associated with DC arcing conditions can contribute to further switch mechanism degradation, and perhaps may even lead to catastrophic failure of the fusible switching disconnect device if not carefully controlled. Of course, as the voltage of the DC circuitry increases, electrical arcing issues become more severe.

A number of techniques are known and have been utilized to address electrical arcing concerns when switching DC circuitry. One of them is simply to separate the switch contacts by a distance sufficient to preclude electrical arcing. Thus, once the sufficient distance of separation is obtained, arcing between the contacts will cease. While this technique can be effective, it can result in an undesirably large device for high voltage circuitry.

Another conventional technique for dealing with and mitigating the damaging effects of high energy DC arcs in such fusible switch disconnect devices is to break the current flow into simultaneous series arcs of some division of the system voltage. For example a 600 VDC current can be broken utilizing three different series switches where each switch sees one third of the 600 volts or 200 volts per switch. In such a device, the 200 VDC arcs can then be broken in a shorter distance than if a single switch were used. Thus, in this example, a 3-series pole switch design can be preferable to a single-pole device requiring a longer breaking distance for the switch contacts. However, such three pole switch devices can be relatively expensive to manufacture.

Still other techniques to mitigate arcing concerns in switching DC circuitry include directing a blast of air at the contacts as they are being separated to prevent an arc for occurring or to interrupt an arc in progress, or generating a magnetic field to deflect the arc away from the contacts and weaken arcing conditions until they cease. Either of these techniques can reduce the physical distance needed to separate the switch contacts in the device. They can, however, be unreliable in some aspects and are less effective for higher voltage circuitry than lower voltage circuitry.

It would be desirable to provide a more compact, simpler, and lower cost solution to arcing issues for fusible switching disconnect devices than has heretofore been provided.

FIG. 1 illustrates an array 50 of fusible circuit protection devices 100 that may pose electrical arcing issues and may benefit from the inventive arc suppression techniques described below when utilized to protect high energy, DC circuitry. The fusible circuit protection devices 100 are arranged in a plurality of rows 52 wherein the devices 100 are arranged side-by-side with eight such devices 100 in each row. In the example shown, three rows 52 are depicted for a total of twenty-four devices 100 in the array. However, even greater numbers of rows may be provided depending on the power system being protected. Also, it is understood that the devices 100 may be arranged in columns instead or rows, or in columns and rows as desired.

The rows 52 of devices 100 may further be provided in an enclosure 54 including a base wall 56, lateral side walls 58 and 60 depending from the base wall 56, end walls 62 and 64 depending from the base wall 56 and interconnecting the side walls 58 and 60, and an optional lid. The rows 52 of devices 100 may be mounted to a DIN Rail (not shown in FIG. 1) extending on the base wall 54. The enclosure is sometimes referred to as a combiner box wherein a relatively large number of electrical connections, both line side and load side in the power system, are established. The combiner box may be mounted vertically or horizontally at any location necessary or desired. In other applications, the enclosure may be referred to as an electrical panel, control panel, or panelboard that also accommodates other electrical components besides the fusible circuit protection devices 100.

In normal operation, current flows from the line side through each device 100 and the fuse therein to the load side protected circuitry. Using the switches provided in the devices 100, the load side circuitry associated with the devices 100 may be electrically isolated from the line side, independent of any operation of the fuse itself. As such, the devices 100 may desirably be switched on and off without having to remove the fuses. The switches of such devices may be opened manually or automatically in response to detected circuit conditions, even in anticipation of an opening of the fuse.

The possible opening and closing of the switches, whether manually or automatically, in a relatively large number of devices 100 in close proximity to one another requires effective arc suppression when the circuitry protected is high energy, high voltage DC circuitry.

Figure 2:
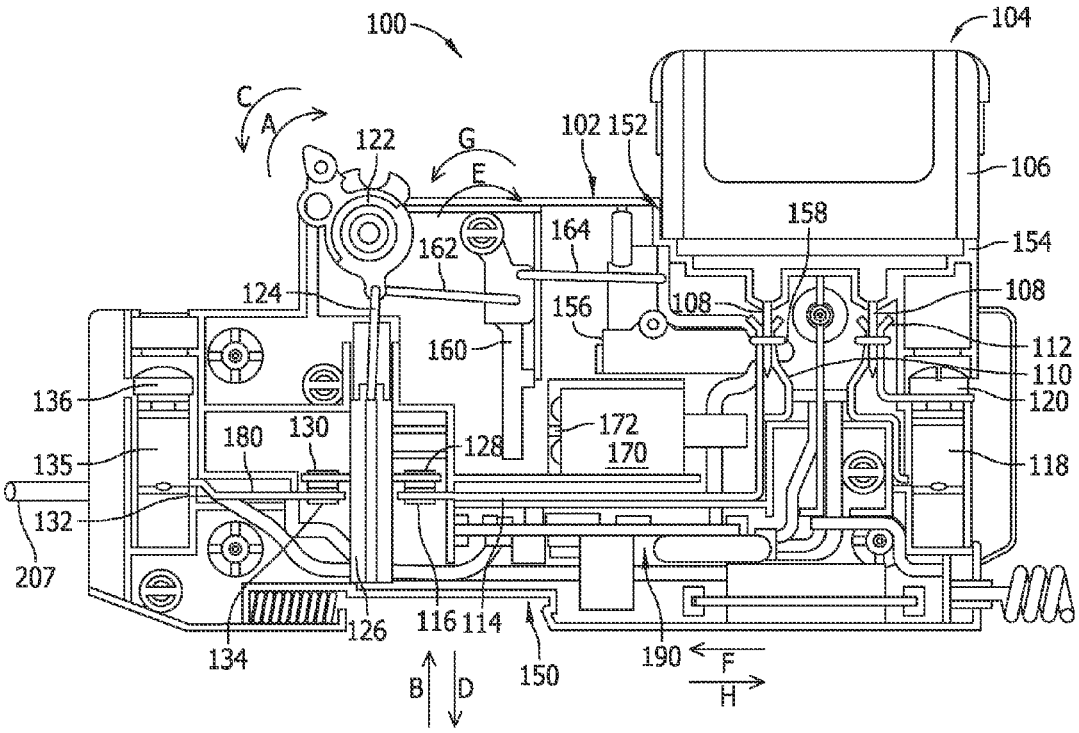
FIG. 2 is a side elevational view of a portion of an exemplary embodiment of a fusible switching disconnect device.

FIG. 2 is a side elevational view of a portion of an exemplary embodiment of a fusible switching disconnect device 100 for the array 50 shown in FIG. 1. The disconnect device 100 generally includes a disconnect housing 102 and a finger-safe rectangular fuse module 104 having terminal blades received in pass through openings in the top of the disconnect device 100 such that the fuse module 104 can be plugged-in to the disconnect housing 102 or removed from the disconnect housing 102 by hand by grasping the exposed housing of the rectangular fuse module and either pushing it toward the disconnect housing 102 to engage the terminal blades or pulling it away from the disconnect housing 102 to disengage the terminal blades from connecting terminals in the disconnect housing 102. Such an arrangement has been well received and one of its benefits is that it does not require conventional tools to engage or disengage conventional fasteners to remove or install the fuse module 104.

The device 100 includes a disconnect housing 102 fabricated from an electrically nonconductive or insulative material such as plastic, and the disconnect housing 102 is configured or adapted to receive a retractable rectangular fuse module 104. The disconnect housing 102 and its internal components described below, are sometimes referred to as a base assembly that receives the retractable fuse module 104. The internal components of the disconnect housing 102 include switching elements and actuator components described further below, although it should be understood that the disconnect housing 102 and its internal components represent only one example of a possible disconnect device that may benefit from the exemplary tool and inspection methods described further below.

The fuse module 104 in the exemplary embodiment shown includes a rectangular housing 106 fabricated from an electrically nonconductive or insulative material such as plastic, and conductive terminal elements in the form of terminal blades 108 extending from the housing 106. In the example shown, the terminal blades 108 extend in spaced apart but generally parallel planes extending perpendicular to the plane of the page of FIG. 2. A primary fuse element or fuse assembly is located within the housing 106 and is electrically connected between the terminal blades 108 to provide a current path therebetween. Such fuse modules 104 are known and in one embodiment the rectangular fuse module 104 is a CUBEFuse™power fuse module commercially available from Cooper Bussmann of St. Louis, Mo. The fuse module 104 provides overcurrent protection via the primary fuse element therein that is configured to melt, disintegrate or otherwise fail and permanently open the current path through the fuse element between the terminal blades 108 in response to predetermined current conditions flowing through the fuse element in use. When the fuse element opens in such a manner, the fuse module 104 must be removed and replaced to restore affected circuitry.

A variety of different types of fuse elements, or fuse element assemblies, are known and may be utilized in the fuse module 104 with considerable performance variations in use. Also, the fuse module 104 may include fuse state indication features, a variety of which are known in the art, to identify the permanent opening of the primary fuse element such that the fuse module 104 can be quickly identified for replacement via a visual change in appearance when viewed from the exterior of the fuse module housing 106. Such fuse state indication features may involve secondary fuse links or elements electrically connected in parallel with the primary fuse element in the fuse module 104.

A conductive line side fuse clip 110 may be situated within the disconnect housing 102 and may receive one of the terminal blades 108 of the fuse module 104. A conductive load side fuse clip 112 may also be situated within the disconnect housing 102 and may receive the other of the fuse terminal blades 108. The line and load side fuse clips 110, 112 may be biased with spring elements and the like to provide some resistance to the plug-in installation and removal of the respective terminal blades, and also to ensure sufficient contact force to ensure electrical connection therebetween when the terminal blades 110, 112 are engaged.

The line side fuse clip 110 may be electrically connected to a first line side terminal 114 provided in the disconnect housing 102, and the first line side terminal 114 may include a stationary switch contact 116. The load side fuse clip 112 may be electrically connected to a load side connection terminal 118. In the example shown, the load side connection terminal 118 is a box lug terminal operable with a screw 120 to clamp or release an end of a connecting wire to establish electrical connection with load side electrical circuitry. Other types of load side connection terminals are known, however, and may be provided in alternative embodiments.

A rotary switch actuator 122 is further provided in the disconnect housing 102, and is mechanically coupled to an actuator link 124 that, in turn, is coupled to a sliding actuator bar 126. The actuator bar 126 carries a pair of switch contacts 128 and 130. In an exemplary embodiment, the switch actuator 122, the link 124 and the actuator bar 128 may be fabricated from nonconductive materials such as plastic. A second conductive line side terminal 132 including a stationary contact 134 is also provided, and a line side connecting terminal 135 is also provided in the disconnect housing 102. In the example shown, the line side connection terminal 135 is a box lug terminal operable with a screw 136 to clamp or release an end of a connecting wire to establish electrical connection with line side electrical circuitry. Other types of line side connection terminals are known, however, and may be provided in alternative embodiments. While in the illustrated embodiment the line side connecting terminal 135 and the load side connecting terminal 118 are of the same type (i.e., both are box lug terminals), it is contemplated that different types of connection terminals could be provided on the line and load sides of the disconnect housing 102 if desired.

Electrical connection of the device 100 to power supply circuitry, sometimes referred to as the line side, may be accomplished in a known manner using the line side connecting terminal 135. Likewise, electrical connection to load side circuitry may be accomplished in a known manner using the load side connecting terminal 118. As mentioned previously, a variety of connecting techniques are known (e.g., spring clamp terminals and the like) and may alternatively be utilized to provide a number of different options to make the electrical connections in the field. The configuration of the connecting terminals 135 and 118 accordingly are exemplary only.

In the position shown in FIG. 2, the disconnect device 100 is shown in the closed position with the switch contacts 130 and 128 mechanically and electrically engaged to the stationary contacts 134 and 116, respectively. As such, when the device 100 is connected to line side circuitry with a first connecting wire via the line side connecting terminal 135, and also when the load side terminal 118 is connected to load side circuitry with a connecting wire via the connecting terminal 118, a circuit path is completed through conductive elements in the disconnect housing 102 and the fuse module 104 when the fuse module 104 is installed and when the primary fuse element therein is in a non-opened, current carrying state.

Specifically, electrical current flow through the device 100 is as follows when the switch contacts 128 and 130 are closed, when the device 100 is connected to line and load side circuitry, and when the fuse module 104 is installed. Electrical current flows from the line side circuitry through the line side connecting wire to and through the line side connecting terminal 135. From the line side connecting terminal 135 current then flows to and through the second line terminal 132 and to the stationary contact 134. From the stationary contact 134 current flows to and through the switch contact 130, and from the switch contact 130 current flows to and through the switch contact 128. From the switch contact 128 current flows to and through the stationary contact 116, and from the stationary contact 116 current flows to and through the first line side terminal 114. From the first line side terminal 114 current flows to and through the line side fuse clip 112, and from the line side fuse clip 112 current flows to and through the first mating fuse terminal blade 108. From the first terminal blade 108 current flows to and through the primary fuse element in the fuse module 104, and from the primary fuse element to and through the second fuse terminal blade 108. From the second terminal blade 108 current flows to and through the load side fuse clip 112, and from the load side fuse clip 112 to and through the load side connecting terminal 118. Finally, from the connecting terminal 118 current flows to the load side circuitry via the wire connected to the terminal 118. As such, a circuit path or current path is established through the device 100 that includes the fuse element of the fuse module 104.

In the example shown, disconnect switching to temporarily open the current path in the device 100 may be accomplished in multiple ways. First, and as shown in FIG. 2, a portion of the switch actuator 122 projects through an upper surface of the disconnect housing 102 and is therefore accessible to be grasped for manual manipulation by a person. Specifically, the switch actuator 122 may be rotated from a closed position as shown in FIG. 2 to an open position in the direction of arrow A, causing the actuator link 124 to move the sliding bar 126 linearly in the direction of arrow B and moving the switch contacts 130 and 128 away from the stationary contacts 134 and 116. Eventually, the switch contacts 130 and 128 become mechanically and electrically disengaged from the stationary contacts 134 and 116 and the circuit path between the first and second line terminals 114 and 132, which includes the primary fusible element of the fuse module 104, may be opened via the separation of the switch contacts 130 and 114 when the fuse terminal blades 108 are received in the line and load side fuse clips 110 and 112.

When the circuit path in the device 100 is opened in such a manner via rotational displacement of the switch actuator 122, the fuse module 104 becomes electrically disconnected from the first line side terminal 132 and the associated line side connecting terminal 135. In other words, an open circuit is established between the line side connecting terminal 135 and the first terminal blade 108 of the fuse module 104 that is received in the line side fuse clip 110. The operation of switch actuator 122 and the displacement of the sliding bar 126 to separate the contacts 130 and 128 from the stationary contacts 134 and 116 may be assisted with bias elements such as the springs. Particularly, the sliding bar 126 may be biased toward the open position wherein the switch contacts 130 and 128 are separated from the contacts 134 and 136 by a predetermined distance. The dual switch contacts 134 and 116 mitigate, in part, electrical arcing concerns as the switch contacts 134 and 116 are engaged and disengaged by dividing the arcing potential to two different locations.

Once the switch actuator 122 of the disconnect device 100 is switched open to interrupt the current path in the device 100 and disconnect the fuse module 104, the current path in the device 100 may be closed to once again complete the circuit path through the fuse module 104 by rotating the switch actuator 122 in the opposite direction indicated by arrow C in FIG. 1. As the switch actuator 122 rotates in the direction of arrow C, the actuator link 124 causes the sliding bar 126 to move linearly in the direction of arrow D and bring the switch contacts 130 and 128 toward the stationary contacts 134 and 114 to close the circuit path through the first and second line terminals 114 and 132. As such, by moving the actuator 122 to a desired position, the fuse module 104 and associated load side circuitry may be connected and disconnected from the line side circuitry while the line side circuitry remains "live" in an energized, full power condition. Alternatively stated, by rotating the switch actuator 122 to separate or join the switch contacts, the load side circuitry may be electrically isolated from the line side circuitry, or electrically connected to the line side circuitry on demand. While the switch actuator 122 and associated switching components is desirable in many applications, it is contemplated that the switch actuator 122 and related switching components may in some embodiments be considered optional and may be omitted.

Additionally, the fuse module 104 may be simply plugged into the fuse clips 110, 112 or extracted therefrom to install or remove the fuse module 104 from the disconnect housing 102. The fuse housing 106 projects from the disconnect housing 102 and is open and accessible from an exterior of the disconnect housing 102 so that a person simply can grasp the fuse housing 106 by hand and pull or lift the fuse module 104 in the direction of arrow B to disengage the fuse terminal blades 108 from the line and load side fuse clips 110 and 112 until the fuse module 104 is completely released from the disconnect housing 102. An open circuit is established between the line and load side fuse clips 110 and 112 when the terminal blades 108 of the fuse module 104 are removed as the fuse module 104 is released, and the circuit path between the fuse clips 110 and 112 is completed when the fuse terminal blades 108 are engaged in the fuse clips 110 and 112 when the fuse module 104 is installed. Thus, via insertion and removal of the fuse module 104, the circuit path through the device 100 can be opened or closed apart from the position of the switch contacts as described above.

Of course, the primary fuse element in the fuse module 104 provides still another mode of opening the current path through the device 100 when the fuse module is installed in response to actual current conditions flowing through the fuse element. As noted above, however, if the primary fuse element in the fuse module 104 opens, it does so permanently and the only way to restore the complete current path through the device 100 is to replace the fuse module 104 with another one having a non-opened fuse element. As such, and for discussion purposes, the opening of the fuse element in the fuse module 104 is permanent in the sense that the fuse module 100 cannot be reset to once again complete the current path through the device. Mere removal of the fuse module 104, and also displacement of the switch actuator 122 as described, are in contrast considered to be temporary events and are resettable to easily complete the current path and restore full operation of the affected circuitry by once again installing the fuse module 104 and/or closing the switch contacts.

The fuse module 104, or a replacement fuse module, can be conveniently and safely grasped by hand via the fuse module housing 106 and moved toward the switch housing 102 to engage the fuse terminal blades 108 to the line and load side fuse clips 110 and 112. The fuse terminal blades 108 are extendable through openings in the disconnect housing 102 to connect the fuse terminal blades 108 to the fuse clips 110 and 112. To remove the fuse module 104, the fuse module housing 106 can be grasped by hand and pulled from the disconnect housing 102 until the fuse module 104 is completely released. As such, the fuse module 104 having the terminal blades 108 may be rather simply and easily plugged into the disconnect housing 102 and the fuse clips 110, 112, or unplugged as desired.

Such plug-in connection and removal of the fuse module 104 advantageously facilitates quick and convenient installation and removal of the fuse module 104 without requiring separately supplied fuse carrier elements common to some conventional fusible disconnect devices. Further plug-in connection and removal of the fuse module 104 does not require conventional tools (e.g., screwdrivers and wrenches) and associated fasteners (e.g., screws, nuts and bolts) common to other known fusible disconnect devices. Also, the fuse terminal blades 108 extend through and outwardly project from a common side of the fuse module body 106, and in the example shown the terminal blades 108 each extend outwardly from a lower side of the fuse housing 106 that faces the disconnect housing 102 as the fuse module 104 is mated to the disconnect housing 102.

In the exemplary embodiment shown, the fuse terminal blades 108 extending from the fuse module body 106 are generally aligned with one another and extend in respective spaced-apart parallel planes. It is recognized, however, that the terminal blades 108 of the module 106 in various other embodiments may be staggered or offset from one another, need not extend in parallel planes, and can be differently dimensioned or shaped. The shape, dimension, and relative orientation of the terminal blades 108, and the receiving fuse clips 110 and 112 in the disconnect housing 102 may serve as fuse rejection features that only allow compatible fuses to be used with the disconnect housing 102. In any event, because the terminal blades 108 project away from the lower side of the fuse housing 106, a person's hand when handling the fuse module housing 106 for plug in installation (or removal) is physically isolated from the terminal blades 108 and the conductive line and load side fuse clips 110 and 112 that receive the terminal blades 108 as mechanical and electrical connections therebetween are made and broken. The fuse module 104 is therefore touch safe (i.e., may be safely handled by hand to install and remove the fuse module 104 without risk of electrical shock).

The disconnect device 100 is rather compact and occupies a reduced amount of space in an electrical power distribution system including the line side circuitry and the load side circuitry than other known fusible disconnect devices and arrangements providing similar effect. In the embodiment illustrated in FIG. 2 the disconnect housing 102 is provided with a DIN rail slot 150 that may be used to securely mount the disconnect housing 102 in place with snap-on installation to a DIN rail by hand and without tools. The DIN rail may be located in a cabinet or supported by other structure, and because of the smaller size of the device 100, a greater number of devices 100 may be mounted to the DIN rail in comparison to conventional fusible disconnect devices.

In another embodiment, the device 100 may be configured for panel mounting by replacing the line side terminal 135, for example, with a panel mounting clip. When so provided, the device 100 can easily occupy less space in a fusible panelboard assembly, for example, than conventional in-line fuse and circuit breaker combinations. In particular, CUBEFuse™ power fuse modules occupy a smaller area, sometimes referred to as a footprint, in the panel assembly than non-rectangular fuses having comparable ratings and interruption capabilities. Reductions in the size of panelboards are therefore possible, with increased interruption capabilities.

In ordinary use of the exemplary device 100 as shown, the circuit path or current path through the device 100 is preferably connected and disconnected at the switch contacts 134, 130, 128, 116 rather than at the fuse clips 110 and 112. By doing so, electrical arcing that may occur when connecting/disconnecting the circuit path may be contained at a location away from the fuse clips 110 and 112 to provide additional safety for persons installing, removing, or replacing fuses. By opening the switch contacts with the switch actuator 122 before installing or removing the fuse module 104, any risk posed by electrical arcing or energized conductors at the fuse and disconnect housing interface is eliminated. The disconnect device 100 is accordingly believed to be safer to use than many known fused disconnect switches.

The disconnect switching device 100 includes still further features, however, that improve the safety of the device 100 in the event that a person attempts to remove the fuse module 104 without first operating the actuator 122 to disconnect the circuit through the fuse module 104, and also to ensure that the fuse module 104 is compatible with the remainder of the device 100. That is, features are provided to ensure that the rating of the fuse module 104 is compatible with the rating of the conductive components in the disconnect housing 102.

As shown in FIG. 2, the disconnect housing 102 in one example includes an open ended receptacle or cavity 152 on an upper edge thereof that accepts a portion of the fuse housing 106 when the fuse module 104 is installed with the fuse terminal blades 108 engaged to the fuse clips 110, 112. The receptacle 152 is shallow in the embodiment depicted, such that a relatively small portion of the fuse housing 106 is received when the terminal blades 108 are plugged into the disconnect housing 102. A remainder of the fuse housing 106, however, generally projects outwardly from the disconnect housing 102 allowing the fuse module housing 106 to be easily accessed and grasped with a user's hand and facilitating a finger safe handling of the fuse module 104 for installation and removal without requiring conventional tools. It is understood, however, that in other embodiments the fuse housing 106 need not project as greatly from the switch housing receptacle when installed as in the embodiment depicted, and indeed could even be substantially entirely contained within the switch housing 102 if desired.

In the exemplary embodiment shown in FIG. 2, the fuse housing 106 includes a recessed guide rim 154 having a slightly smaller outer perimeter than a remainder of the fuse housing 106, and the guide rim 154 is seated in the switch housing receptacle 152 when the fuse module 104 is installed. It is understood, however, that the guide rim 154 may be considered entirely optional in another embodiment and need not be provided. The guide rim 154 may in whole or in part serve as a fuse rejection feature that would prevent someone from installing a fuse module 104 having a rating that is incompatible with the conductive components in the disconnect housing 102. Fuse rejection features could further be provided by modifying the terminal blades 108 in shape, orientation, or relative position to ensure that a fuse module having an incompatible rating cannot be installed.

In contemplated embodiments, the base of the device 100 (i.e., the disconnect housing 102 and the conductive components therein) has a rating that is ½ of the rating of the fuse module 104. Thus, for example, a base having a current rating of 20 A may preferably be used with a fuse module 104 having a rating of 40 A. Ideally, however, fuse rejection features such as those described above would prevent a fuse module of a higher rating, such as 60 A, from being installed in the base. The fuse rejection features in the disconnect housing 102 and/or the fuse module 104 can be strategically coordinated to allow a fuse of a lower rating (e.g., a fuse module having a current rating of 20 A) to be installed, but to reject fuses having higher current ratings (e.g., 60 A and above in the example being discussed). It can therefore be practically ensured that problematic combinations of fuse modules and bases will not occur. While exemplary ratings are discussed above, they are provided for the sake of illustration rather than limitation. A variety of fuse ratings and base ratings are possible, and the base rating and the fuse module rating may vary in different embodiments and in some embodiments the base rating and the fuse module rating may be the same.

As a further enhancement, the disconnect housing 102 includes an interlock element 156 that frustrates any effort to remove the fuse module 104 while the circuit path through the first and second line terminals 132 and 114 via the switch contacts 134, 130, 128, 116 is closed. The exemplary interlock element 156 shown includes an interlock shaft 158 at a leading edge thereof, and in the locked position shown in FIG. 1 the interlock shaft 158 extends through a hole in the first fuse terminal blade 108 that is received in the line side fuse clip 110. Thus, as long as the projecting interlock shaft 158 is extended through the opening in the terminal blade 108, the fuse module 104 cannot be pulled from the fuse clip 110 if a person attempts to pull or lift the fuse module housing 106 in the direction of arrow B. As a result, and because of the interlock element 156, the fuse terminal blades 108 cannot be removed from the fuse clips 110 and 112 while the switch contacts 128, 130 are closed and potential electrical arcing at the interface of the fuse clips 110 and 112 and the fuse terminal blades 108 is avoided. Such an interlock element 156 is believed to be beneficial for the reasons stated but could be considered optional in certain embodiments and need not be utilized.

The interlock element 156 is coordinated with the switch actuator 122 so that the interlock element 156 is moved to an unlocked position wherein the first fuse terminal blade 108 is released for removal from the fuse clip 110 as the switch actuator 122 is manipulated to open the device 100. More specifically, a pivotally mounted actuator arm 160 is provided in the disconnect housing 102 at a distance from the switch actuator 122, and a first generally linear mechanical link 162 interconnects the switch actuator 122 with the arm 160. The pivot points of the switch actuator 122 and the arm 160 are nearly aligned in the example shown in FIG. 1, and as the switch actuator 122 is rotated in the direction of arrow A, the link 162 carried on the switch actuator 122 simultaneously rotates and causes the arm 160 to rotate similarly in the direction of arrow E. As such, the switch actuator 122 and the arm 160 are rotated in the same rotational direction at approximately the same rate.

A second generally linear mechanical link 164 is also provided that interconnects the pivot arm 160 and a portion of the interlock element 156. As the arm 160 is rotated in the direction of arrow E, the link 164 is simultaneously displaced and pulls the interlock element 156 in the direction of arrow F, causing the projecting shaft 158 to become disengaged from the first terminal blade 108 and unlocking the interlock element 156. When so unlocked, the fuse module 104 can then be freely removed from the fuse clips 110 and 112 by lifting on the fuse module housing 106 in the direction of arrow B. The fuse module 104, or perhaps a replacement fuse module 104, can accordingly be freely installed by plugging the terminal blades 108 into the respective fuse clips 110 and 112.

As the switch actuator 122 is moved back in the direction of arrow C to close the disconnect device 100, the first link 162 causes the pivot arm 160 to rotate in the direction of arrow G, causing the second link 164 to push the interlock element 156 in the direction of arrow H until the projecting shaft 158 of the interlock element 156 again passes through the opening of the first terminal blade 108 and assumes a locked position with the first terminal blade 108. As such, and because of the arrangement of the arm 160 and the links 162 and 164, the interlock element 156 is slidably movable within the disconnect housing 102 between locked and unlocked positions. This slidable movement of the interlock element 156 occurs in a substantially linear and axial direction within the disconnect housing 102 in the directions of arrow F and H in FIG. 1.

In the example shown, the axial sliding movement of the interlock element 156 is generally perpendicular to the axial sliding movement of the actuator bar 116 that carries the switchable contacts 128 and 130. In the plane of FIG. 1, the movement of the interlock element 156 occurs along a substantially horizontal axis, while the movement of the sliding bar 126 occurs along a substantially vertical axis. The vertical and horizontal actuation of the sliding bar 126 and the interlock element 156, respectively, contributes to the compact size of the resultant device 100, although it is contemplated that other arrangements are possible and could be utilized to mechanically move and coordinate positions of the switch actuator 122, the switch sliding bar 126 and the interlock element 156. Also, the interlock element 156 may be biased to assist in moving the interlock element to the locked or unlocked position as desired, as well as to resist movement of the switch actuator 122, the sliding bar 126 and the interlock element 156 from one position to another. For example, by biasing the switch actuator 122 to the opened position to separate the switch contacts, either directly or indirectly via bias elements acting upon the sliding bar 126 or the interlock element 156, inadvertent closure of the switch actuator 122 to close the switch contacts and complete the current path may be largely, if not entirely frustrated, because once the switch contacts are opened a person must apply a sufficient force to overcome the bias force and move the switch actuator 122 back to the closed position shown in FIG. 2 to reset the device 100 and again complete the circuit path. If sufficient bias force is present, it can be practically ensured that the switch actuator 122 will not be moved to close the switch via accidental or inadvertent touching of the switch actuator 122.

The interlock element 156 may be fabricated from a nonconductive material such as plastic according to known techniques, and may be formed into various shapes, including but not limited to the shape depicted in FIG. 1. Rails and the like may be formed in the disconnect housing 102 to facilitate the sliding movement of the interlock element 156 between the locked and unlocked positions.

The pivot arm 160 is further coordinated with a tripping element 170 for automatic operation of the device 100 to open the switch contacts 128, 130. That is, the pivot arm 160, in combination a tripping element actuator described below, and also in combination with the linkage 124, 162, and 164 define a tripping mechanism to force the switch contacts 128, 130 to open independently from the action of any person. Operation of the tripping mechanism is fully automatic, as described below, in response to actual circuit conditions, as opposed to the manual operation of the switch actuator 122 described above. Further, the tripping mechanism is multifunctional as described below to not only open the switch contacts, but to also to displace the switch actuator 122 and the interlock element 156 to their opened and unlocked positions, respectively. The pivot arm 160 and associated linkage may be fabricated from relatively lightweight nonconductive materials such as plastic.

In the example shown in FIG. 2, the tripping element actuator 160 is an electromagnetic coil such as a solenoid having a cylinder or pin 172, sometimes referred to as a plunger, that is extendable or retractable in the direction of arrow F and H along an axis of the coil. The coil when energized generates a magnetic field that causes the cylinder or pin 172 to be displaced. The direction of the displacement depends on the orientation of the magnetic field generated so as to push or pull the plunger cylinder or pin 172 along the axis of the coil. The plunger cylinder or pin 172 may assume various shapes (e.g., may be rounded, rectangular or have other geometric shape in outer profile) and may be dimensioned to perform as hereinafter described.

In the example shown in FIG. 2, when the plunger cylinder or pin 172 is extended in the direction of arrow F, it mechanically contacts a portion of the pivot arm 160 and causes rotation thereof in the direction of arrow E. As the pivot arm 160 rotates, the link 162 is simultaneously moved and causes the switch actuator 122 to rotate in the direction of arrow A, which in turn pulls the link 124 and moves the sliding bar 126 to open the switch contacts 128, 130. Likewise, rotation of the pivot arm 160 in the direction of arrow E simultaneously causes the link 164 to move the interlock element 156 in the direction of arrow F to the unlocked position.

It is therefore seen that a single pivot arm 160 and the linkage 162 and 164 mechanically couples the switch actuator 122 and the interlock element 156 during normal operation of the device, and also mechanically couples the switch actuator 122 and the interlock element 156 to the tripping element 170 for automatic operation of the device. In the exemplary embodiment shown, an end of the link 124 connecting the switch actuator 122 and the sliding bar 126 that carries the switch contacts 128, 130 is coupled to the switch actuator 122 at approximately a common location as the end of the link 162, thereby ensuring that when the tripping element 170 operates to pivot the arm 160, the link 162 provides a dynamic force to the switch actuator 122 and the link 124 to ensure an efficient separation of the contacts 128 and 130 with a reduced amount of mechanical force than may otherwise be necessary. The tripping element actuator 170 engages the pivot arm 160 at a good distance from the pivot point of the arm 160 when mounted, and the resultant mechanical leverage provides sufficient mechanical force to overcome the static equilibrium of the mechanism when the switch contacts are in the opened or closed position. A compact and economical, yet highly effective tripping mechanism is therefore provided. Once the tripping mechanism operates, it may be quickly and easily reset by moving the switch actuator 122 back to the closed position that closes the switch contacts.

Suitable solenoids are commercially available for use as the tripping actuator element 170. Exemplary solenoids include LEDEX® Box Frame Solenoid Size B17M of Johnson Electric Group (www.ledexx.com) and ZHO-0520L/S Open Frame Solenoids of Zohnen Electric Appliances (www.zonhen.com). In different embodiments, the solenoid 170 may be configured to push the arm 160 and cause it to rotate, or to pull the contact arm 160 and cause it to rotate. That is, the tripping mechanism can be operated to cause the switch contacts to open with a pushing action on the pivot arm 160 as described above, or with a pulling action on the pivot arm 160. Likewise, the solenoid could operate on elements other than the pivot arm 160 if desired, and more than one solenoid could be provided to achieve different effects.

In still other embodiments, it is contemplated that actuator elements other than a solenoid may suitably serve as a tripping element actuator to achieve similar effects with the same or different mechanical linkage to provide comparable tripping mechanisms with similar benefits to varying degrees. Further, while simultaneous actuation of the components described is beneficial, simultaneous activation of the interlock element 156 and the sliding bar 126 carrying the switch contacts 128, 130 may be considered optional in some embodiments and these components could accordingly be independently actuated and separately operable if desired. Different types of actuator could be provided for different elements.

Moreover, in the embodiment shown the trip mechanism is entirely contained within the disconnect housing 102 while still providing a relatively small package size. It is recognized, however, that in other embodiments the tripping mechanism may in whole or in part reside outside the disconnect housing 102, such as in separately provided modules that may be joined to the disconnect housing 102. As such, in some embodiments, the trip mechanism could be, at least in part, considered an optional add-on feature provided in a module to be used with the disconnect housing 102. Specifically, the trip element actuator and linkage in a separately provided module may be mechanically linked to the switch actuator 122, the pivot arm 160 and/or the sliding bar 126 of the disconnect housing 102 to provide comparable functionality to that described above, albeit at greater cost and with a larger overall package size.

The tripping element 170 and associated mechanism may further be coordinated with a detection element and control circuitry to automatically move the switch contacts 128, 130 to the opened position when predetermined electrical conditions occur. In one exemplary embodiment, the second line terminal 132 is provided with an in-line detection element 180 that is monitored by control circuitry 190. As such, actual electrical conditions can be detected and monitored in real time and the tripping element 170 can be intelligently operated to open the circuit path in a proactive manner independent of operation of the fuse module 104 itself and/or any manual displacement of the switch actuator 122. That is, by sensing, detecting and monitoring electrical conditions in the line terminal 132 with the detection element 180, the switch contacts 128, 130 can be automatically opened with the tripping element 170 in response to predetermined electrical conditions that are potentially problematic for either of the fuse module 104 or the base assembly (i.e., the disconnect housing 102 and its components).

In particular, the control circuitry 190 may open the switch contacts in response to conditions that may otherwise, if allowed to continue, cause the primary fuse element in the fuse module 104 to permanently open and interrupt the electrical circuit path between the fuse terminals 108. Such monitoring and control may effectively prevent the fuse module 104 from opening altogether in certain conditions, and accordingly save it from having to be replaced, as well as providing notification to electrical system operators of potential problems in the electrical power distribution system. Beneficially, if permanent opening of the fuse is avoided via proactive management of the tripping mechanism, the device 100 becomes, for practical purposes, a generally resettable device that may in many instances avoid any need to locate a replacement fuse module, which may or may not be readily available if needed, and allow a much quicker restoration of the circuitry than may otherwise be possible if the fuse module 104 has to be replaced. It is recognized, however, that if certain circuit conditions were to occur, permanent opening of the fuse 104 may be unavoidable.

Exemplary embodiments of arcless switching arrangements, which may be incorporated in the devices 100 and the array 50 as described above, will now be explained in relation to the circuit schematics shown in FIGS. 3 through 5. It is to be understood, however, that the schematics shown in FIGS. 3 though 5 do not necessarily require the particulars of the device 100 and/or the fuse 104 for implementation. The device 100 and fuse 104 are therefore non-limiting examples of the type of fusible switching disconnect device that would benefit from the arcless switching techniques illustrated. Methodology of providing such arcless switching conditions will be in part explicitly discussed and in part apparent from the embodiments and examples discussed below.

As will be described in detail below, arcless switching of DC circuitry is made possible by connecting and controlling semiconductor switch devices to resistively control current flow through the device prior to switching of the contacts in the device. That is, by virtue of a semiconductor switch, the energy available to produce electrical arcing can effectively be shutdown or eliminated before switch is opened. Consequently, electrical arcing cannot occur as the switch is opened, and damage to the switch contacts and/or the disconnect device due to arc energy that may otherwise result from electrical arcing, and also damage to the switch contacts and/or to the disconnect device from sustained electrical arcing is completely avoided. Moreover, by effectively eliminating any possibility of an arc occurring, the safety of the devices 100 and the array 50 in use is even further enhanced.

Figure 3:
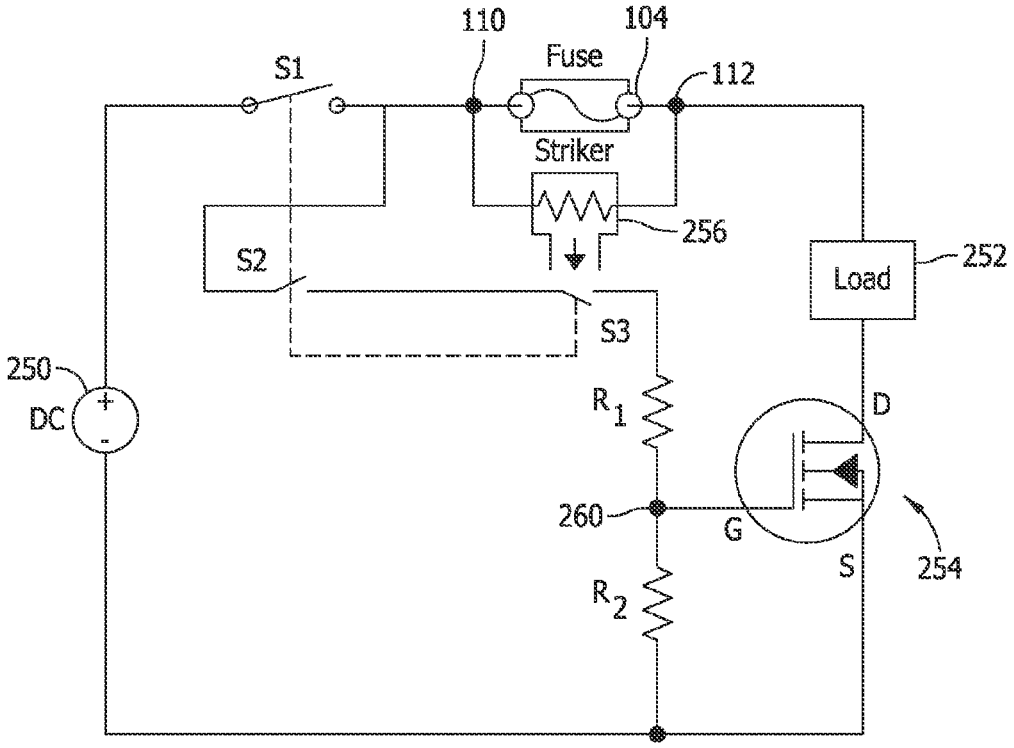
FIG. 3 is a circuit schematic of a first embodiment of a fusible switching disconnect device providing arcless switching.

FIG. 3 illustrates a first exemplary circuit schematic of a fusible switch disconnect device including arcless switch operation. As shown in FIG. 3, fuse 104 is connected to a DC power supply circuit 250 via the switch S1 and provides overcurrent protection to an electrical load 252. A second switch S2 is also provided in series with switch S1 and establishes an electrical path in parallel with the fuse 104. A third switch S3 is connected in series with the switch S2 and effectively controls a semiconductor switch 254 connected in series with the load 252. The semiconductor switch 254 is biased by resistors $R_1$ and $R_2$.

In the example shown in FIG. 3, switch S1 is the primary disconnect switch and may correspond, for example to the switch contacts 128 and 130 (FIG. 2) in the device 100. Connection to the DC power supply 250 may be established, for example, with the line side wire 207 and the line side terminal 135 (FIG. 2) in the device 100. The load 252 shown in FIG. 3 may correspond to the load side terminal 118 and a connecting wire therefore in the device 100. The switch S2 and S3, and the semiconductor switch 254 and its biasing resistors $R_1$ and $R_2$ may be provided interior to the disconnect housing 102 of the device 100, or may alternatively be provided in a separately provided module attachable to the disconnect housing 100.

In operation, the primary switch S1 is linked to S2 and S3 for control of the semiconductor switch 254, which in the example shown is provided in the form of a Metal-Oxide-Semiconductor Field Effect Transistor (MOSFET). Switch S2 is a late make on the closing of S1 and an early break on the opening of S1 so that the DC current is resistively switched within the MOSFET 254. The switching of the MOSFET 254 creates an arcless condition for the primary switch S1 to electrically isolate the load 252 from the power supply circuitry 250.

In the exemplary embodiment shown in FIG. 3 the MOSFET 254 is a known n-type MOSFET element having a source S, a drain D, and a gate G. The gate G is connected to a terminal 260 between the resistors R1 and R2 and in series with switches S2 and S3 so that the voltage across the fuse 104 is also placed across the gate G of the MOSFET element 254. The flow of electrons between the source S and the drain D is controlled by the voltage applied to the gate G.

In an illustrative embodiment, the MOSFET element 254 is an Enhancement mode MOSFET and possesses a positive gate-to-source threshold value, $V_{gs\ (threshold)}$. When a positive value of gate-to-source voltage ($V_{gs}$) rises to and exceeds this value, the drain-to-source current rises rapidly if a positive value of drain-to-source voltage is simultaneously present. The rate of current rise per unit change in gate voltage is called the forward transconductance of the device, gfs. As those in the art will appreciate, the forward transconductance value may range from small values (about 0.1 for example) to large values (about 100 for example), depending upon the construction of the MOSFET element 254. Therefore, for small changes in gate voltage, large changes in drain-source current are possible.

The MOSFET element 254 resistively prevents current from flowing through the fuse 104, and hence makes arcless operation of the primary switch S1 possible as described above. The MOSFET element 254 is operable according to the following relationship where $V_{DC}$ is the operating voltage of the circuitry being protected, as determined by the power supply circuitry 250, and when switches 51, S2 and S3 are closed and the fuse 104 is installed and is in a non-opened current carrying state:

$$V_{gs} = \left(\frac{R_2}{R_1 + R_2}\right) * V_{DC}. \tag{1}$$

As long as $V_{gs}$ is higher than the threshold value $V_{gs\ (threshold)}$ for the MOSFET element 254, which defines a turn on voltage for the MOSFET element 254, drain to source current will flow through the MOSFET element 254. In normal operating conditions, when switches 51, S2 and S3 are closed with the fuse installed, and while the power supply circuitry 250 is energized, $V_{gs}$ will always be higher than a threshold value $V_{gs\ (threshold)}$ and current will flow through switch S1 and the fuse 104 to the load 252 as long.

On the other hand, if $V_{gs}$ is at a value below the threshold value $V_{gs\ (threshold)}$, the MOSFET element 254 is essentially "off" with a drain current typically on the order of one or two microamperes. Thus, in the "off" state, effectively no current flows from drain D to source S. It is easily seen from FIG. 3 that when switch S3 is opened, $V_{gs}$ will always be lower than the threshold value $V_{gs\ (threshold)}$, even when switches S1 and S2 remain closed. Thus, when switches S1 and S2 are closed, closure of switch S3 causes the MOSFET element 254 to turn "on", and opening of switch S3 causes the MOSFET element 254 to turn "off". Because the fuse 104 and the load 252 are connected in series with the MOSFET element 254, switch S1 may be opened with the MOSFET element 254 in the "off" state without risk of electrical arcing.

Because the gate threshold voltage $V_{gs\ (threshold)}$ of the MOSFET element 254 is a value fixed by the construction of the MOSFET element 254, the biasing resistors R1 and R2 can be selected to provide the desired sensitivity of the MOSFET element 254 to opening and closing the electrical path from source to drain. In some cases, the biasing resistors which effect a voltage divide network may not be necessary depending on the particular threshold voltage $V_{gs\ (threshold)}$ of the MOSFET element 254.

In one example, in an initial state switches S1 and S2 are opened and switch S3 is a normally closed switch. Hence, in the initial state the MOSFET is in the "off" state". When the primary switch S1 is closed, such as by rotating the actuator 122 in the device 100 (FIG. 2) as described above, the secondary switch S2 is caused to close just after switch S1. When switch S2 is closed, because switch S3 is also closed the MOSFET element 254 is turned on, and current starts to flow through switch S1 and the fuse 104 to the load 252. In another embodiment, switch S3 could be selectively controlled to close in response to the closure of switch S1 or S2.

When the primary switch S1 is opened, such as by rotating the actuator 122 in the device 100 (FIG. 2) as described above, switch S2 first opens and causes the MOSFET element 254 to turn off Current flow through the switch S1 and the fuse 104 to the load 252 then ceases, and because switch S1 is a late break counterpart to switch S2, by the time switch S1 opens there practically is no current flow (or an insufficient current flow to cause electrical arcing) through the switch S1 as it opens. Thus, electrical arcing issues as the switch S1 opens are effectively avoided.

Switch S3 facilitates automatic de-activation of the MOSFET element 254 when the primary fuse element in the fuse 104 operates to interrupt the circuit therethrough. Thus, as shown in FIG. 3, when the fuse 104 includes a secondary fuse link and a mechanical striker element 256, the striker element can mechanically change the state of switch S3. Thus, when switch S3 is closed, the striker element 256 can cause it to open, and when switch S3 is opened the MOSFET element 254 turns off Striker elements are well known in the fuse art, and various different types of such elements are known and may be used to physically activate the switch S3 when the primary fuse element opens. Briefly, when the primary fuse element opens, current is diverted to the secondary fuse link, and degradation of the secondary fuse link as it opens causes release of the striker element. Of course, in embodiments wherein the fuse 104 does not include such as striker element, switch S3 could be considered optional and could be omitted.

In embodiments including the striker element 256, a trip free switch function is provided. When the fuse 104 operates and deploys its striker element 256, which may be a pin, the primary switch S1 (and the secondary switch S2 if present) may be tripped open in the device 100 in a manner that will not allow reclosure until a new fuse 104 is installed. Such trip-free functionality provides a means of maintaining proper isolation of the load circuitry during maintenance and inspection of a faulted circuit that caused the fuse 104 to open, thereby enhancing and ensuring the safety to those responsible for maintaining the circuitry. Such, trip-free functionality could be initiated in the control circuitry 190 to cause automatic operation of the switch contacts 128, 130 (FIG. 2) to open in the device 100 when the fuse 104 opens with the trip mechanism described.

While the MOSFET element 254 illustrated in FIG. 3 is an n-type MOSFET, it is appreciated that p-type MOSFET elements and equivalent devices may likewise be used with similar effect. Likewise, equivalent types of semiconductor switch elements other than MOSFET elements may be used, including but not limited to a bipolar transistor, an insulated gate bipolar transistor (IGBT), element, and the like.

Figure 4:
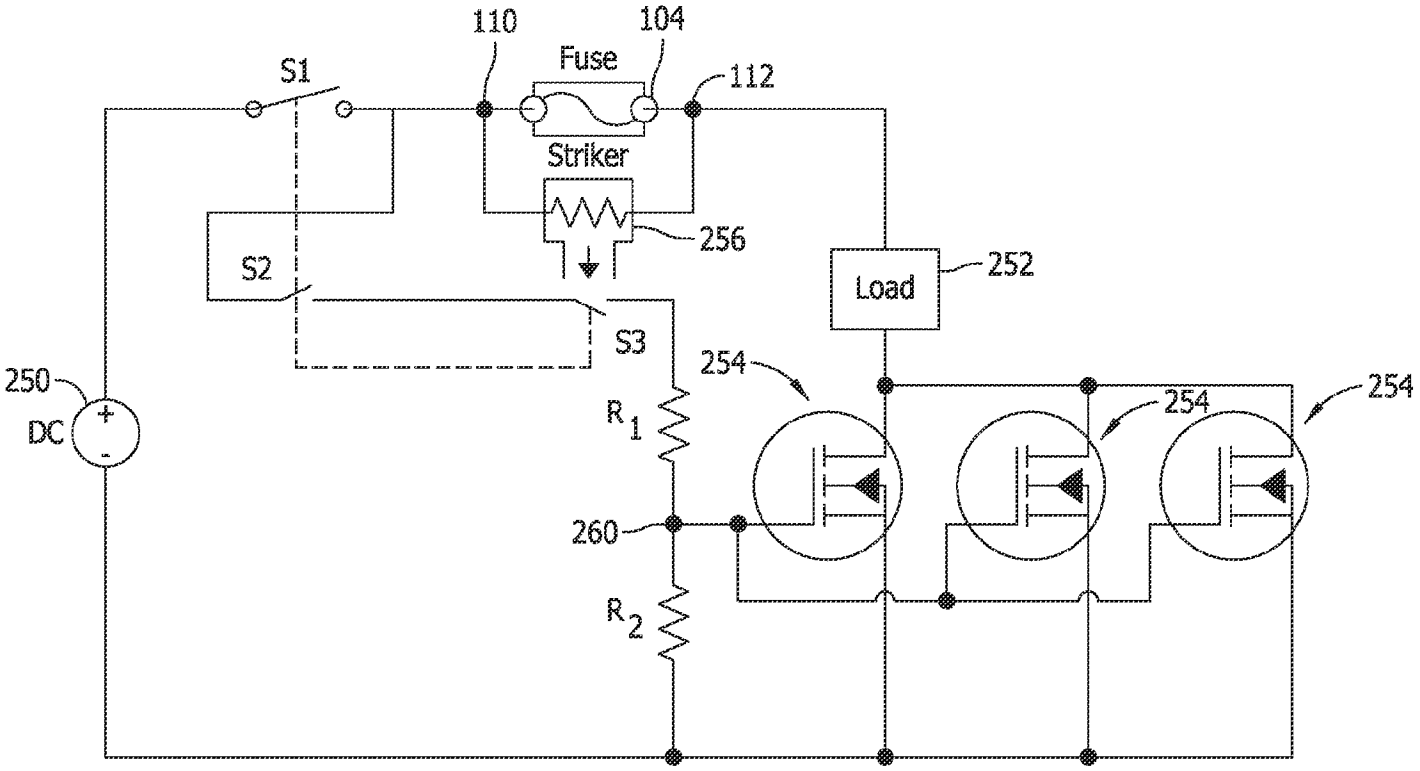
FIG. 4 is a circuit schematic of a second embodiment of a fusible switching disconnect device providing arcless switching.

FIG. 4 illustrates an embodiment similar to that of FIG. 3 but including multiple MOSFET elements 254 connected in parallel. The load voltage is divided over the MOSFET elements 254, and the MOSFET elements 254 may collectively eliminate current flowing through to the load in an amount that none of the MOSFET elements 254 on their own could provide. The embodiment of FIG. 4 may therefore be desirable for higher current circuitry than the embodiment of FIG. 3. While three MOSFET elements 254 are shown in FIG. 4, greater or fewer numbers of MOSFET elements 254 may be provided. Except for the plurality of MOSFET elements 254, the operation of the circuit is the same as discussed above. Switch S3 is utilized to collectively operate all of the MOSFET elements 254 to turn them on and off.

Figure 5:
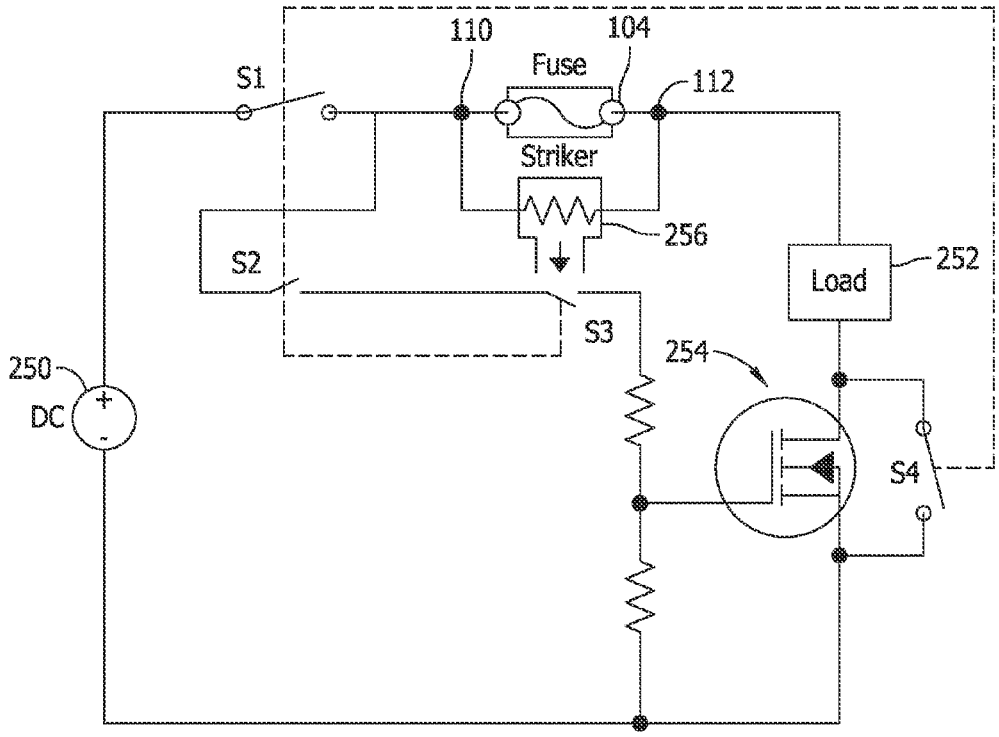
FIG. 5 is a circuit schematic of a third embodiment of a fusible switching disconnect device providing arcless switching.

FIG. 5 illustrates still another embodiment similar to the embodiment of FIG. 3, but including an additional switch S4 that shunts out the MOSFET element 254 during normal current operation. In comparison to the embodiment discussed above in FIG. 3, the embodiment of FIG. 4 allows a smaller MOSFET element 254 to be employed because the current will be divided between the shunt switch S4 and the MOSFET element 254. During the opening of the primary switch 51, the switch S4 must open first to allow the MOSFET element 254 to resistively shutdown the current before the primary switch 51 breaks contact.

The benefits and advantages of the inventive concepts disclosed are now believed to be evident from the embodiments and examples disclosed.

An embodiment of a fusible switch disconnect device has been disclosed including: a fuse; a primary switch connected in series with the fuse; and a semiconductor switch device connected in parallel with the fuse. The semiconductor device is configured to resist current flow through the fuse and the primary fuse to facilitate arcless operation of the primary switch when connected to energized, DC circuitry.

Optionally, the fusible switch disconnect device further includes a secondary switch connected in parallel with the fuse and in series with the semiconductor switch, the secondary switch establishing a late break and early make connection to the primary switch. The fusible switch disconnect may also include a third switch connected in series with the second switch, the third switch causing the semiconductor switch to change between an on state and an off state. The fuse may include a striker element, with the striker element actuating the third switch when the fuse operates. The fusible switch disconnect device may include a fourth switch, the fourth switch connected in parallel with the semiconductor switch device.

Optionally, the semiconductor switch device may be a MOSFET element. The MOSFET element may be an n type MOSFET element. The semiconductor switch device may also be one of a MOSFET element, a bipolar transistor element or an IGBT element. The semiconductor switch device may include a plurality of semiconductor switch devices, each of the plurality of semiconductor switch devices being connected in parallel with one another.

The fuse may be a rectangular fuse module, and the fuse module includes plug-in terminal blades. The fusible switch disconnect device may further include a disconnect housing, the primary switch located in the switch housing. The primary switch may include a first movable contact and a second movable contact spaced apart from the first contact. The first and second movable contacts may be carried on a slidable bar in the disconnect housing. The fusible switch disconnect device may also include a rotary actuator for operating the primary switch, and a trip mechanism for automatically opening the primary switch in response to a circuit condition. A linkage may connect the trip mechanism and the actuator, wherein operation of the tripping mechanism causes the actuator to assume an opened position and operate the primary switch. The trip mechanism may be configured to prevent reclosure of the primary switch unless the fuse is replaced.

The semiconductor switch device may be connected in series with a load side output of the fuse. A second switch may be provided, with the second switch controlling operation of the semiconductor switch. The fusible switch disconnect device may include a disconnect housing, with the fuse projecting from the disconnect housing when installed.

Another embodiment of a fusible switch disconnect device has been disclosed including: a line side fuse terminal; a primary switch connected in series with the line side fuse terminal; a load side fuse terminal; and a semiconductor switch device connected in series with the load side fuse terminal and also connected in parallel with the line side fuse terminal, wherein the semiconductor device is configured to resist current flow from the line side fuse terminal to facilitate arcless operation of the primary switch when a fuse is connected to the line side terminals and the load side terminal and when the line side fuse terminal of the disconnected device is connected to energized, DC circuitry.

Optionally, the fusible switch disconnect device may further include a secondary switch connected in parallel with the line side fuse terminal and connected in series with the semiconductor switch. The fusible switch disconnect may also include a third switch connected in series with the second switch, the third switch causing the semiconductor switch to change between an on state and an off state. The fuse may include a striker element, and the third switch may be actuated by the striker element when the fuse operates. The fusible switch disconnect device may include a fourth switch, the further switch connected in parallel with the semiconductor switch device.

The semiconductor switch device may be a MOSFET element, and may be an n type MOSFET element. The semiconductor switch may also be one of a MOSFET element, a bipolar transistor element or an IGBT element. The semiconductor switch device may include comprises a plurality of semiconductor switch devices, each of the plurality of semiconductor switch devices being connected in parallel with one another.

The fusible switch disconnect device may include a disconnect housing, the primary switch located in the switch housing. The primary switch may include a first movable contact and a second movable contact spaced apart from the first contact. The first and second movable contacts may be carried on a slidable bar in the disconnect housing. The fusible switch disconnect device may also include a rotary actuator for operating the primary switch, and a trip mechanism for automatically opening the primary switch in response to a circuit condition. The fusible switch disconnect device may include a linkage connecting the trip mechanism and the actuator, wherein operation of the tripping mechanism causes the actuator to assume an opened position and operate the primary switch. The trip mechanism may be configured to prevent reclosure of the primary switch unless the fuse is replaced.

Optionally, each of the line side fuse terminal and the load side fuse terminal may be configured to accept a terminal blade contact of the fuse.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fusible switch disconnect device comprising:

first and second fuse terminals structured to removably accept an overcurrent protection fuse;

a first primary switch connected in series with the first fuse terminal; and a semiconductor switch device connected in series with the second fuse terminal, wherein when the overcurrent protection fuse is accepted the semiconductor switch device is operable to resist current flow through the first primary switch, thereby facilitating arcless operation of the first primary switch when the fusible switch disconnect device is connected to energized, DC circuitry; and a second switch connected to the first primary switch and establishing a late break and early make connection to the first primary switch.

2. The fusible switch disconnect device of claim 1, further comprising a third switch connected to the second switch, the third switch causing the semiconductor switch device to change between an on state and an off state.

3. The fusible switch disconnect device of claim 2, wherein the overcurrent protection fuse includes a striker element, and the third switch positioned in the fusible disconnect switch device to be actuated by the striker element when the overcurrent protection fuse operates.

4. The fusible switch disconnect device of claim 2, further comprising a fourth switch, the fourth switch connected in parallel with the semiconductor switch device.

5. The fusible switch disconnect device of claim 1, wherein the semiconductor switch device is a MOSFET element.

6. The fusible switch disconnect device of claim 5, wherein the MOSFET element is an n type MOSFET element.

7. The fusible switch disconnect device of claim 1, wherein the semiconductor switch device is one of a MOSFET element, a bipolar transistor element or an IGBT element.

8. The fusible switch disconnect device of claim 1, wherein the semiconductor switch device comprises a plurality of semiconductor switch devices, each of the plurality of semiconductor switch devices being connected in parallel with one another.

9. The fusible switch disconnect device of claim 1, in combination with the overcurrent protection fuse, wherein the overcurrent protection fuse comprises a rectangular fuse module.

10. The fusible switch disconnect device of claim 9 wherein the rectangular fuse module includes plug-in terminal blades.

11. The fusible switch disconnect device of claim 1, further comprising a disconnect housing, the first and second fuse terminals and also the first primary switch located in the disconnect housing.

12. The fusible switch disconnect device of claim 11, wherein the first primary switch includes a first movable contact and a second movable contact spaced apart from the first movable contact.

13. The fusible switch disconnect device of claim 12, wherein the first and second movable contacts are carried on a slidable bar in the disconnect housing.

14. The fusible switch disconnect device of claim 1, further comprising a rotary actuator for operating the first primary switch.

15. The fusible switch disconnect device of claim 14, further comprising a trip mechanism for automatically opening the first primary switch in response to a circuit condition.

16. The fusible switch disconnect device of claim 15, further comprising a linkage connecting the trip mechanism and the rotary actuator, wherein operation of the trip mechanism causes the rotary actuator to assume an opened position and operate the first primary switch.

17. The fusible switch disconnect device of claim 15, wherein the trip mechanism is structured to prevent reclosure of the first primary switch unless the overcurrent protection fuse is replaced.

18. The fusible switch disconnect device of claim 1, wherein the semiconductor switch device is connected in series with a load side output of the overcurrent protection fuse when the overcurrent protection fuse is accepted.

19. The fusible switch disconnect device of claim 1, further comprising a third switch, the third switch controlling operation of the semiconductor switch device.

20. The fusible switch disconnect device of claim 1, further comprising a disconnect housing, the overcurrent protection fuse projecting from the disconnect housing when installed.

21. A fusible switch disconnect device comprising:

a line side fuse terminal;

a primary switch connected in series with the line side fuse terminal;

a load side fuse terminal; and a semiconductor switch device connected in series with the load side fuse terminal, wherein the semiconductor switch device is operable to resist current flow from the line side fuse terminal to facilitate arcless operation of the primary switch when a fuse is connected to the line side fuse terminal and the load side fuse terminal and when the line side fuse terminal of the fusible switch disconnect device is connected to energized, DC circuitry; and a secondary switch establishing an electrical path in parallel with the line side fuse terminal and connected in series with the semiconductor switch device.

22. The fusible switch disconnect device of claim 21, further comprising a third switch connected in series with the secondary switch, the third switch causing the semiconductor switch device to change between an on state and an off state.

23. The fusible switch disconnect device of claim 22, in combination with a fuse including a striker element, and wherein the third switch is actuated by the striker element when the fuse operates.

24. The fusible switch disconnect device of claim 22, further comprising a fourth switch, the fourth switch connected in parallel with the semiconductor switch device.

25. The fusible switch disconnect device of claim 21, wherein the semiconductor switch device is a MOSFET element.

26. The fusible switch disconnect device of claim 25, wherein the MOSFET element is an n type MOSFET element.

27. The fusible switch disconnect device of claim 21, wherein the semiconductor switch device is one of a MOSFET element, a bipolar transistor element or an IGBT element.

28. The fusible switch disconnect device of claim 21, wherein the semiconductor switch device comprises a plurality of semiconductor switch devices, each of the plurality of semiconductor switch devices being connected in parallel with one another.

29. The fusible switch disconnect device of claim 21, further comprising a disconnect housing, the primary switch located in the switch housing.

30. The fusible switch disconnect device of claim 28, wherein the primary switch includes a first movable contact and a second movable contact spaced apart from the first movable contact.

31. The fusible switch disconnect device of claim 29, wherein the first and second movable contacts are carried on a slidable bar in the disconnect housing.

32. The fusible switch disconnect device of claim 21, further comprising a rotary actuator for operating the primary switch.

33. The fusible switch disconnect device of claim 32, further comprising a trip mechanism for automatically opening the primary switch in response to a circuit condition.

34. The fusible switch disconnect device of claim 33, further comprising a linkage connecting the trip mechanism and the rotary actuator, wherein operation of the trip mechanism causes the rotary actuator to assume an opened position and operate the primary switch.

35. The fusible switch disconnect device of claim 34, wherein the trip mechanism is structured to prevent reclosure of the primary switch unless the fuse is replaced.

36. The fusible switch disconnect device of claim 21, wherein each of the line side fuse terminal and the load side fuse terminal is structured to accept a terminal blade contact of the fuse.

* * * * *